United States Patent [19]

Ellsworth et al.

[11] Patent Number: 4,637,182

[45] Date of Patent: Jan. 20, 1987

[54] WINDOWED FIRE DOOR

[75] Inventors: Wendell E. Ellsworth; Raymond P. Birdsall, both of Green Bay, Wis.

[73] Assignee: Algoma Hardwoods, Inc., Algoma, Wis.

[21] Appl. No.: 848,931

[22] Filed: Apr. 7, 1986

[51] Int. Cl.[4] ..... E06B 3/58

[52] U.S. Cl. ..... 52/211; 52/455; 52/476; 52/727; 52/775

[58] Field of Search ..... 52/476, 750, 765, 764, 52/232, 400, 397, 727, 776, 211; 49/399, 396

[56] References Cited

U.S. PATENT DOCUMENTS

| | | | |
|---|---|---|---|
| 2,617,159 | 11/1952 | Leighton | 52/455 |
| 3,783,567 | 1/1974 | Ollis | 52/232 |
| 4,144,688 | 3/1979 | Dixon | 52/232 |
| 4,164,108 | 8/1979 | Ortmanns | 52/764 |
| 4,583,342 | 4/1986 | Lier | 52/455 |

*Primary Examiner*—John E. Murtagh

*Attorney, Agent, or Firm*—James E. Nilles

[57] ABSTRACT

The pane in a windowed fire retardant door is secured to the door by L-shaped metal clips which engage opposite surfaces of the pane and are nailed to the incombustible core of the door. The edges of the pane and of the hole in the door in which the pane is received are trimmed by bead strips that are nailed to the door. Each bead strip comprises a body of quadrangular cross-section of noncombustible mineral material and a plywood lamination bonded to that body over two of its longitudinal sides and a rounded corner at which those sides meet.

4 Claims, 5 Drawing Figures

WINDOWED FIRE DOOR

This invention relates to windowed fire doors and is more particularly concerned with the securement and framing of a pane of glass that serves as a light or vision panel in a fire retardant door of the type comprising a core of noncombustible mineral material and a facing of wood veneer overlying and bonded to each of the opposite surfaces of the core.

BACKGROUND OF THE INVENTION

A fire retardant door—often referred to as a fire door—is installed in a building for preventing the spread of fire from one part of the building to another. To fulfill that purpose a fire door must be made substantially entirely of incombustible material. But a fire door must also be regarded as part of the interior of a living space, and as such it must be aesthetically satisfactory. Usually, therefore, the core of incombustible material that comprises the main structure of a fire door is overlain with a thin wood veneer facing that provides it with a desirably attractive appearance.

For safety reasons as well as for admission of light, a fire door is often provided with a window, usually having a glass pane in which a wire mesh is embedded. This pane should be sealed around its edge to the incombustible core of the fire door, and for aesthetic reasons as well as to ensure the necessary seal, should be surrounded by a suitable frame or bead. Various types of metal frames have been devised for fire door windows, some of which provide for securement of the pane to the fire door core as well as for trimming the margin of the pane and the edges of the hole in the door in which the pane is installed. Such metal frames must be painted to match or simulate the wood of the door facing, requiring a special finish different from that applied to the wood. A metal frame is seldom as attractive as a wood frame would be. Furthermore, any slight chipping or abrasion of the painted surface of a metal frame exposes the metal and tends to make the whole door unattractive.

U.S. Pat. No. 2,927,353, to Snitker, discloses a windowed fire retarding door wherein the window pane is secured and sealed to the door structure by means of a body of incombustible material which is initially in slurry form and in which the marginal portions of the pane are embedded all around the pane. The arrangement as disclosed is not objectionable in appearance, but it is not particularly attractive. More important, embedding the pane in the incombustible material requires that the pane be supported in some manner, to be held in the proper position and attitude relative to the door frame until the slurry has set up or hardened to a substantial extent, and this requirement greatly complicates manufacture of the door because the pane must be supported at portions of it that are not embedded in the slurry.

As is suggested by the deficiencies in Snitker's teachings, the provision of satisfactory means for supporting, sealing and trimming the pane in a windowed fire door requires an arrangement that is not only aesthetically attractive and structurally sound but is also capable of fast and easy installation, preferably by one person and with the use of simple conventional tools. Heretofore there has been no expedient for the purpose which has fully satisfied all of thse requirements.

SUMMARY OF THE INVENTION

The general object of this invention is to provide means for supporting and trimming the pane of glass in the window of a windowed fire retardant door whereby the pane is supported by and sealed to the incombustible core of the door and has its marginal edge portion surrounded by a trim which is substantially incombustible but which nevertheless has the appearance of natural wood even when it is in an unfinished state.

It is also an object of the invention to provide means for trimming and supporting the glass pane in a windowed fire retardant door that can be installed by one person working unassisted and with the use of simple tools.

A further object of the invention is to provide a windowed fire retardant door which is more attractive in appearance than those heretofore available, having a neat trimming bead around its window which matches the appearance of the wood veneer that comprises the facing of the remainder of the door, but which is nevertheless no more expensive than equivalent prior doors and is in no wise inferior to them with respect to the essential fire retardant characteristics.

It is also an object of the invention to provide a bead strip for trimming the window of a fire retardant door that is substantially incombustible, easily installed and pleasing in appearance.

BRIEF DESCRIPTION OF THE DRAWINGS

In the accompanying drawings, which depict what is now regarded as a preferred embodiment of the invention.

DETAILED DESCRIPTION OF THE PREFERRED EMBODIMENT OF THE INVENTION

Figure 1:
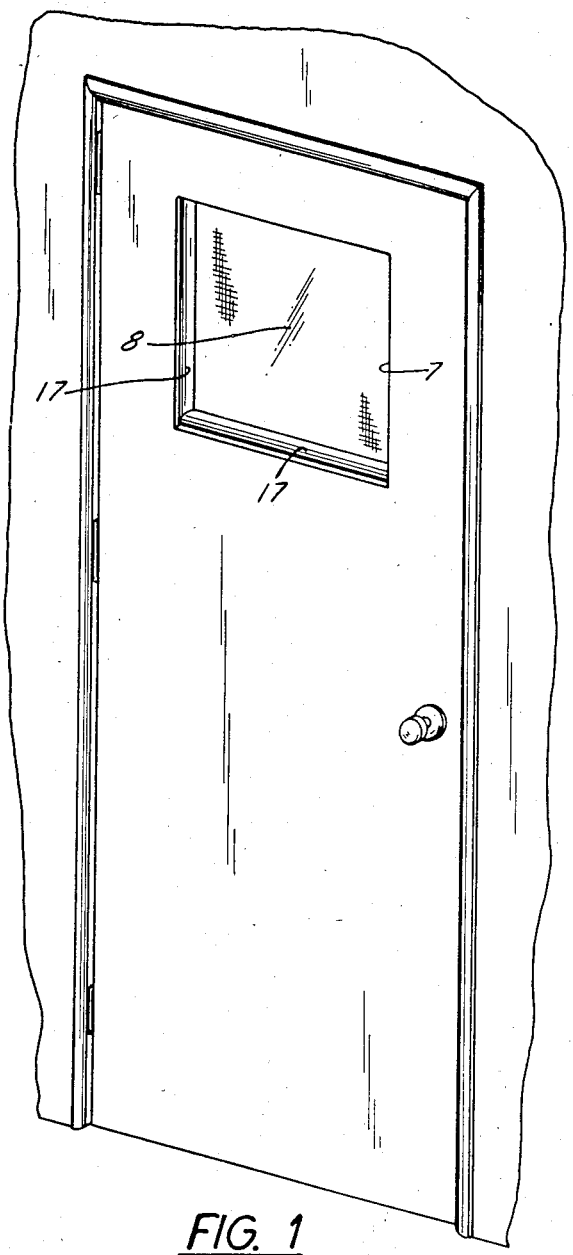
FIG. 1 is a perspective view of a fire retardant door that embodies the principles of this invention.
Figure 2:
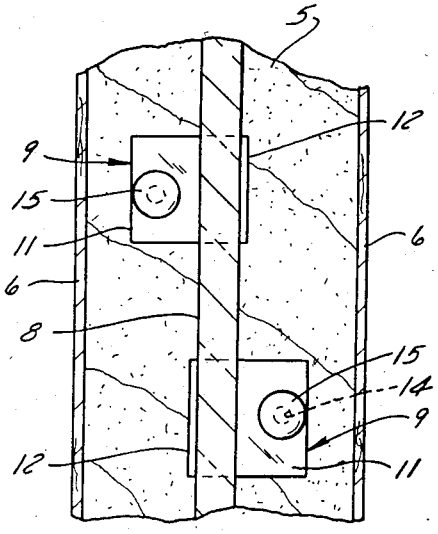
FIG. 2 is a fragmentary view in section through the window pane in the door showing the clips that support it and with the bead strips not yet installed.
Figure 3:
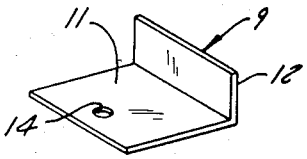
FIG. 3 is a perspective view of one of the clips.
Figure 5:
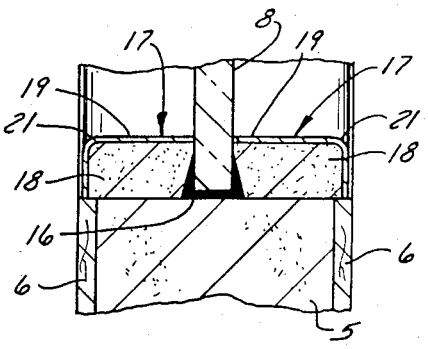
FIG. 5 is a view generally similar to FIG. 4 but illustrating a modified form of bead strip.
Figure 4:
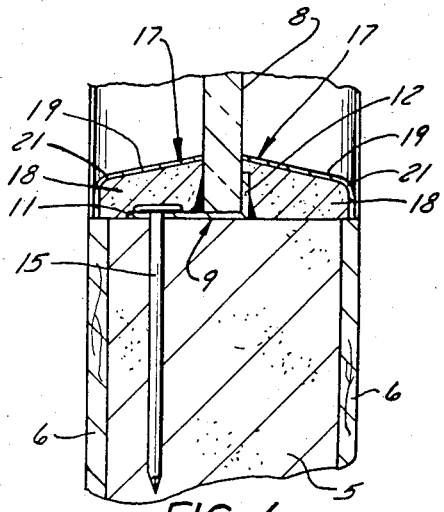
FIG. 4 is a view in section through the door and the window pane at one of the clips, with the bead strips installed.

A fire retardant door that embodies the principles of this invention comprises a core 5 of incombustible material that has a thin veneer 6 of wood overlying and bonded to each of its opposite surfaces. The core 5 is relied upon to provide the door with its fire retardant properties, and the wood veneer 6, which is applied to it for the sake of appearance, is preferably treated to resist burning.

Through the body of the door is a hole 7 that comprises its window, in which a pane of glass 8 is supported and secured as described below. As is conventional with fire retardant doors, the glass pane 8 has wire mesh embedded in it. The pane is of such size in relation to the hole 7 in which it is received that there is a space of about 1/32 in. (about 0.75 mm.) between its edge and the core 5 of the door body, this spacing being maintained all around it by metal clips 9 that secure it to the core.

Each of the clips 9 can be cut from a flat strip of metal and bent to be substantially L-shaped, having a pair of flat legs 11, 12, each of which has its opposite flat surfaces perpendicular to those of the other. One leg 11 has a nail hole 14 therethrough that is near its edge remote from the other leg. Each clip 9 is secured to the door by a single nail 15 through its nail hole 14 that is driven into the incombustible core 5.

When the glass pane 8 has been installed in the door, it is secured by at least two clips 9 at each of its edges and is confined between the unapertured legs 12 of these clips, which flatwise engage its opposite surfaces, while the apertured leg 11 of each clip extends across the edge of the pane to have its nail hole 14 at the side of the pane remote from the surface thereof that the clip engages. The clips 9, although identical with one another, are thus installed in two sets, the clips of one set having their nails 15 at one side of the pane, those of the other set being nailed at the other side of the pane, and every clip having its pane supporting leg 12 engaging the surface of the pane that is remote from the nail that holds the clip.

Before the pane is installed in the hole 7 in the door, one set of clips 9 is nailed in place. Preferably this set comprises at least two clips for each edge of the pane. The pane is then placed into the opening, being slid along the nailed legs 11 of the installed clips until it firmly engages their pane supporting legs 12. The second set of clips 9 is then installed between the clips already in place by sliding the apertured leg 11 of each clip of the second set between the pane edge and the edge of the hole 7 in the door body until the unapertured leg 12 is firmly flatwise engaged with the pane, whereupon the clip is secured to the door by a nail 15 driven into the core 5 through its nail hole 14.

At this point a suitable caulking 16 is applied all around the edge of the pane 8, to fill and seal the space between the pane and the core.

The window opening is trimmed and the clips are concealed by means of bead strips 17 that are nailed to the core on both sides of the pane and along each edge of the hole 7 in which the pane is received. Each bead strip 17 comprises an elongated body 18 of high density noncombustible material that has a substantially quadrangular cross-section, covered on two of its longitudinally extending surfaces by a wood veneer lamination 19.

The noncombustible body 18 is preferably of calcium silicate. Johns-Manville's Marinite (TM) of 46 lbs/cu. ft. density has been found very suitable. The body material can be specially molded or, as is preferred, can be sawed from a sheet (conventionally 4'×8') of suitable thickness. With a sawed body, one corner 21 is preferably rounded, as by sanding. The two longitudinal sides of the body which meet at that corner 21 are covered by the veneer 19, which has its grain oriented lengthwise of the body and which is in one piece, being bent around the rounded corner 21 to closely overlie the body. A 1/64 in.-thick veneer is suitable for the purpose, and is preferably of the same wood species as the veneer 6 that covers the main part of the door. The veneer lamination 19 is bonded to the noncombustible body 18 by means of a contact cement which is applied to both the veneer and the body. The veneer is first laid flat on one surface of the body, then bent around the rounded corner 21 and bonded to the other body surface to be covered. Preferably the veneer is somewhat oversize as to its width and is trimmed after it is bonded to the body 18.

After the veneer is applied and trimmed, the strip material is cut to length, with a 45° mitre at each end of each cut piece. Nail holes are drilled in each strip at regular intervals along its length. The bead strips are installed, after caulking, by nailing them to the core with each strip closely received in the corner defined by the pane and the core edge.

A windowed fire retardant door having its pane installed and trimmed as described above is capable of passing a standard 90-minute test. After about 45 minutes of such a test the glass pane softens and begins to sag but it remains in place in the door. Although a bead strip 17 tends to be destroyed by the stream of water from a fire hose, the clips 9 remain in place and continue to hold the pane.

From the foregoing description it will be apparent that this invention provides a windowed fire retardant door which is more attractive than those heretofore available and which fully meets applicable fire retardancy standards but which is nevertheless no more expensive than equivalent prior doors.

I claim:

1. A windowed fire door comprising a core of incombustible material that has opposite surfaces, a wood veneer facing overlying and bonded to each of said surfaces of the core, and a rectangular pane of glass exending across a hole through said core and said facings and having opposite flat surfaces that are parallel to and spaced inwardly from the respective facings, said fire door being characterized by:

A. a plurality of L-shaped clips, each having a pair of legs with opposite flat surfaces, said surfaces of the respective legs being perpendicular to one another, and one of said legs having a nail hole therethrough that is spaced from the other leg, (1) each said clip having its said one leg extending across an edge of said pane and having its said other leg flatwise engaging the surface of the pane that is remote from said nail hole, (2) each of certain of said clips having its said other leg engaged with one surface of said pane and each of the rest of said clips having its said other leg engaged with the other surface of said pane;

B. a nail through said nail hole of each clip, engaged in said core to secure the clip thereto and thereby confine the pane against displacement relative to the door; and C. a plurality of framing bead strips, one along each edge of the pane at each surface thereof, each said strip being secured to the core to comprise a seal between the core and the pane, each said strip comprising (1) an elongated body of high density incombustible mineral material having a pair of adjacent lengthwise extending surfaces, one of which opposes said core and the other of which opposes said pane, and (2) a veneer of wood overlying and bonded to said strip over the other lengthwise extending surface portions thereof.

2. The windowed fire door of claim 1 wherein said seal further comprises:

caulking material substantially filling the spaces between the edges of said pane and the core.

3. The windowed fire door of claim 1, further characterized by:

a plurality of nails extending through each said strip and into the core to secure the strip to the core.

4. A bead strip for a windowed fire retardant door that comprises a core of incombustible material, wood veneer coverings overlying and bonded to opposite faces of said core, and a glass pane in a window aperture in said door, said bead strip being securable to said core in engagement with it and with a surface of said pane along one edge thereof to trim a marginal portion of said pane, said bead strip being characterized by:

A. an elongated substrate body of high density incombustible calcium silicate material having a cross-section which is uniform along its length and having
   (1) a pair of lengthwise extending inside surfaces which are substantially perpendicular to one another and
   (2) a pair of lengthwise extending outside surfaces, each of which is substantially opposite one of said inside surfaces and which merge into one another around a rounded corner; and B. a lamination of thin wood veneer overlying and bonded to said outside surfaces and said rounded corner over substantially the entire areas thereof, said lamination extending in one piece around said surfaces and said corner and having its grain oriented lengthwise of said substrate body; and C. said strip having nail holes therethrough at intervals along its length, each extending through said substrate body and said lamination and opening to one of said outside surfaces and the inside surface which is substantially opposite the same.

* * * * *